US009991680B2

(12) United States Patent
Ikeda et al.

(10) Patent No.: US 9,991,680 B2
(45) Date of Patent: Jun. 5, 2018

(54) IGNITION PLUG AND PLASMA GENERATION DEVICE

(71) Applicant: IMAGINEERING, INC., Kobe-shi, Hyogo (JP)

(72) Inventors: Yuji Ikeda, Kobe (JP); Seiji Kanbara, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 0 days. days.

(21) Appl. No.: 14/899,229

(22) PCT Filed: Jun. 17, 2014

(86) PCT No.: PCT/JP2014/065964
§ 371 (c)(1),
(2) Date: Mar. 8, 2016

(87) PCT Pub. No.: WO2014/203873
PCT Pub. Date: Dec. 24, 2014

(65) Prior Publication Data

US 2016/0181765 A1 Jun. 23, 2016

(30) Foreign Application Priority Data

Jun. 18, 2013 (JP) ..... 2013-128007

(51) Int. Cl.

| | |
|---|---|
| ***F02P 3/01*** | (2006.01) |
| ***F02P 23/04*** | (2006.01) |
| ***H01T 13/00*** | (2006.01) |
| ***H01T 13/20*** | (2006.01) |
| ***H01T 15/00*** | (2006.01) |
| ***H05H 1/30*** | (2006.01) |
| ***H05H 1/52*** | (2006.01) |
| ***H01T 13/39*** | (2006.01) |

(Continued)

(52) U.S. Cl.
CPC ..... *H01T 13/39* (2013.01); *H01T 13/40* (2013.01); *H01T 13/50* (2013.01); *H05H 1/46* (2013.01)

(58) Field of Classification Search
None
See application file for complete search history.

(56) References Cited

U.S. PATENT DOCUMENTS

2010/0196208 A1* 8/2010 Makita ..... F02P 3/01 422/83
2013/0033188 A1* 2/2013 Katsuraya ..... H01T 13/20 315/209 M

* cited by examiner

*Primary Examiner* — Dedei K Hammond
(74) *Attorney, Agent, or Firm* — Westerman, Hattori, Daniels & Adrian, LLP

(57) ABSTRACT

To provide an ignition plug having low power loss even though iron is a main component of a center electrode thereof, to which a high frequency power such as a microwave is electrically supplied. A low impedance layer 6 composed of a material having magnetic permeability lower than iron is provided between an outer peripheral surface of a center electrode 2 and an inner peripheral surface of an axial hole 30 of an insulator 3. The low impedance layer 6 is in contact with at least the outer peripheral surface (surface) of the center electrode 2, thereby reducing power loss of an electromagnetic wave flowing on the surface of the center electrode 2. More particularly, the low impedance layer 6 is made of silver, copper, gold, aluminum, tungsten, molybdenum, titanium, zirconium, niobium, tantalum, bismuth, palladium, lead, tin, an alloy composed mainly of these metals, or a composite material of these metals.

6 Claims, 5 Drawing Sheets

(51) Int. Cl.

| | |
|---|---|
| ***H01T 13/40*** | (2006.01) |
| ***H01T 13/50*** | (2006.01) |
| ***H05H 1/46*** | (2006.01) |

IGNITION PLUG AND PLASMA GENERATION DEVICE

TECHNICAL FIELD

The present invention relates to an ignition plug at a center electrode of which a pulse voltage for a spark discharge and an electromagnetic wave provided as energy to the spark discharge are electrically supplied.

BACKGROUND ART

Conventionally, there has been developed a plasma generation device that generates local plasma byway of an ignition plug discharge and enlarges the plasma by way of an electromagnetic wave such as a microwave (for example, see Patent Document 1). The plasma generation device is provided with a mixing circuit that mixes energy of a high voltage pulse for the discharge and energy of an electromagnetic wave from an electromagnetic wave generation device. The mixing circuit is electrically connected to an input terminal of the ignition plug. As a result of this, the energy of the electromagnetic wave and the energy of the high voltage pulse are supplied to the ignition plug through a same transmission line (electric path). Accordingly, the ignition plug serves as both a spark discharge electrode and an antenna for electromagnetic wave emission.

However, a center electrode of an ignition plug (a whole portion of the ignition plug that forms a discharge gap with a ground electrode within the ignition plug extending from a terminal part connected with an ignition coil up to a tip end part is referred to as "the center electrode" and the same applies hereinafter) generally used in a conventional plasma generation device is usually constituted by an iron-based alloy except in the tip end portion. This means that the principal component of the center electrode is an iron having a high magnetic permeability. Accordingly, the electromagnetic wave provided from an alternating current power supply flows on a surface of the center electrode, resulting in a great power loss.

Also, Patent Document 2 discloses a technology of providing a high frequency power of between 50 kHz and 100 MHz to a center electrode of an ignition plug, thereby generating plasma between the electrodes.

More particularly, the ignition plug is provided with a tube-shaped insulator having an axial hole penetrating therethrough in an axial direction, the center electrode arranged at a tip end side of the axial hole, a terminal metal fitting arranged in the axial hole closer to a back end side than the center electrode, a main metal fitting arranged in a manner so as to surround the insulator, and a ground electrode electrically connected to the main metal fitting. The terminal metal fitting is electrically connected to the center electrode via an axis and provided with a high frequency power from outside, thereby plasma is generated between the center electrode and the ground electrode. At least apart of an inner surface of the axial hole is formed with a metal coating having electrical conductivity higher than iron and the center electrode is held in electric contact with the metal coating. Also, the terminal metal fitting is held in contact with the metal coating at a position closer to the back end side than the center electrode. In this manner, the ignition plug is provided with a first electrical path adapted to supply the electric power through the terminal metal fitting and the axis to the center electrode and a second electrical path adapted to supply the electric power through the terminal metal fitting and the metal coating to the center electrode. Accordingly, since the cross-section area of the electrical paths increases, the electrical resistance thereof decreases and the power loss is reduced.

However, the axial hole of the insulator of the ignition plug is approximately between 2 mm and 5 mm in inner diameter and approximately between 60 mm and 100 mm in length. The metal coating is required to be formed on the inner surface of the thin axial hole (for example, a paste obtained by mixing a powdered metal in an organic solvent is to be coated thereon). In addition, in order to form the two electrical paths, it is required to provide a gap between the axis and the metal coating, filling the gap with filler such as talc. Thus, there has been a problem of hard and complex manufacture.

Furthermore, the high frequency power disclosed in Patent Document 2 is assumed to be between 50 kHz and 100 MHz in frequency. In a case of a microwave having a frequency (for example, 2 GHz or higher) higher than the high frequency power, since the skin effect increases, there is a need of due consideration of both magnetic permeability and electrical conductivity. Furthermore, in the case of the ignition plug disclosed in Patent Document 2, it is not considered that the ignition plug is supplied with both a pulse voltage for a spark discharge and an electromagnetic wave provided as energy to the spark discharge.

PRIOR ART DOCUMENTS

Patent Documents

Patent Document 1: Japanese Unexamined Patent Application, Publication No. 2009-036198

Patent Document 2: Japanese Unexamined Patent Application, Publication No. 2013-51196

THE DISCLOSURE OF THE INVENTION

Problems to be Solved by the Invention

The present invention has been made in view of the above described circumstances, and it is an object of the present invention to provide an ignition plug having low power loss, even though the center electrode of the ignition plug to which a high frequency power such as a microwave is electrically supplied is composed mainly of iron.

Means for Solving the Problems

In order to solve the above described problems, there is provided an ignition plug, including: a center electrode; an insulator formed with an axial hole, which the center electrode is fitted into; a main metal fitting arranged in a manner so as to surround the insulator; and a ground electrode adapted to form a discharge gap for a spark discharge with the center electrode, wherein the center electrode is electrically supplied with a pulse voltage for the spark discharge and an electromagnetic wave provided as energy to the spark discharge, and a low impedance layer made of a material having magnetic permeability lower than iron is provided between an outer peripheral surface of the center electrode and an inner peripheral surface of the axial hole of the insulator.

With the ignition plug according to the present invention, since the low impedance layer made of the material having magnetic permeability lower than iron is provided between the outer peripheral surface of the center electrode and the inner peripheral surface of the axial hole of the insulator, even an electromagnetic wave having a high frequency exceeding 2 GHz (such as a microwave) can effectively flow on the surface of the center electrode, and it becomes possible to minimize the power loss.

The low impedance layer may be made of silver, copper, gold, aluminum, tungsten, molybdenum, titanium, zirconium, niobium, tantalum, bismuth, palladium, lead, tin, an alloy composed mainly of these metals, or a composite material of these metals. These materials, the alloy composed mainly thereof, and the composite material thereof have magnetic permeability lower than iron, and most of the materials have electrical conductivity higher than iron. Accordingly, the supplied electromagnetic wave can effectively flow on the surface of the center electrode, and it becomes possible to minimize the power loss.

Moreover, the low impedance layer may be configured to be coated on the outer peripheral surface of the center electrode. By coating the low impedance layer on the outer peripheral surface of the center electrode, it is possible to form the low impedance layer with ease.

Furthermore, assuming that μ denotes magnetic permeability of a main component of the low impedance layer, ρ denotes electrical conductivity thereof, and f denotes frequency of the supplied electromagnetic wave, the low impedance layer may be configured to have a thickness expressed by the following expression.

$$(\pi \cdot f \cdot \mu \cdot \rho)^{-1/2}$$

By adjusting the thickness of the low impedance layer to a skin depth of a high frequency current flowing through a conductor, it is possible to minimize coating thickness.

In addition, the low impedance layer may be configured to have a thickness between 1.0 μm and 3.5 μm.

The present invention is further directed to a plasma generation device provided with the ignition plug. There is provided a plasma generation device including: a high voltage pulse generation device for supplying a pulse voltage; an electromagnetic wave oscillator that oscillates an electromagnetic wave; a mixer, being electrically connected to the high voltage pulse generation device and the electromagnetic wave oscillator, adapted to mix energy of the pulse voltage for a spark discharge and energy of the electromagnetic wave; and the ignition plug that introduces the pulse voltage for the spark discharge and the electromagnetic wave provided as energy to the spark discharge into a reaction region in which a combustion reaction or a plasma reaction is performed. As a result of this, the plasma generation device according to the present invention can reduce the power loss of the electromagnetic wave (microwave) introduced into the reaction region. Consequently, it is possible to downsize the electromagnetic wave oscillator.

Effect of the Invention

According to the present invention, since the low impedance layer made of the material having magnetic permeability lower than iron is provided between the outer peripheral surface of the center electrode and the inner peripheral surface of the axial hole of the insulator, even though the center electrode of the ignition plug is composed mainly of iron, which is electrically supplied with both of the pulse voltage for the spark discharge and a high frequency power of the electromagnetic wave such as a microwave provided as energy to the spark discharge, it becomes possible to provide an ignition plug having low power loss of the supplied microwave. Furthermore, in the plasma generation device using the ignition plug, it becomes possible to downsize the electromagnetic wave oscillator, thereby decreasing the size and cost of the overall device.

BEST MODE FOR CARRYING OUT THE INVENTION

In the following, detailed descriptions will be given of embodiments of the present invention with reference to the accompanying drawings. It should be noted that the following embodiments are mere examples that are essentially preferable, and are not intended to limit the scope of the present invention, applied field thereof, or application thereof.

<First Embodiment>

Ignition Plug

The first embodiment is directed to an ignition plug 1 according to the present invention.

Figure 1:
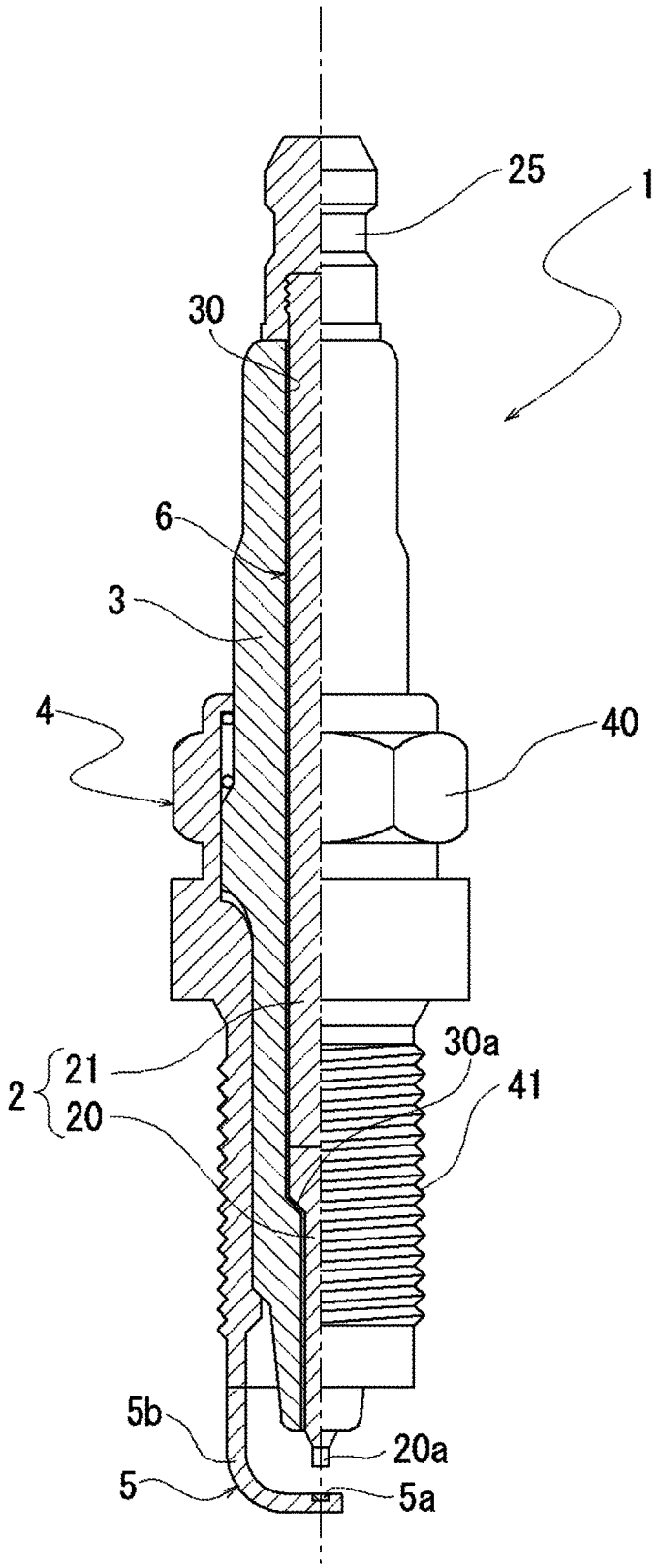
FIG. 1 is a partial cross sectional view of an ignition plug according to a first embodiment of the present invention.

FIG. 1 shows the ignition plug 1 according to the first embodiment. The ignition plug 1 is provided with a center electrode 2, an insulator 3 formed with an axial hole 30 which the center electrode 2 is fitted into, a main metal fitting 4 arranged in a manner so as to surround the insulator 3, and a ground electrode 5 that forms a discharge gap for a spark discharge with the center electrode 2. A pulse voltage for the spark discharge and an electromagnetic wave provided as energy to the spark discharge are electrically supplied to the center electrode 2.

The ignition plug 1 is provided with a low impedance layer 6 made of a material having a magnetic permeability lower than that of an iron between an outer peripheral surface of the center electrode 2 and an inner peripheral surface of the axial hole 30 of the insulator 3. The low impedance layer 6 is arranged to be in contact with at least the outer peripheral surface (surface) of the center electrode 2 and is adapted to reduce a power loss of the electromagnetic wave that flows on the surface of the center electrode 2. More particularly, the low impedance layer 6 is made of silver, copper, gold, aluminum, tungsten, molybdenum, titanium, zirconium, niobium, tantalum, bismuth, lead, tin, an alloy essentially composed of these metals, and/or a composite material of these metals.

The low impedance layer 6 is formed by a coating on the outer peripheral surface of the center electrode 2, more particularly, on outer peripheral surfaces of an electrode main body 20 and a terminal metal fitting 21, which will be described later. The method of coating is not particularly limited. However, a well-known coating method such as a sputtering method or an arc ion plating method may be employed.

Assuming that μ denotes magnetic permeability of a main component of the coating, ρ denotes electrical conductivity of the main component of the coating, and f denotes frequency of the supplied electromagnetic wave, a thickness of the low impedance layer 6, i.e. a thickness d of the metal coating is preferably equal to a value expressed by the following Equation (1).

$$d=(\pi \cdot f \cdot \mu \cdot \rho)^{-1/2}\ (\mu m) \quad (1)$$

Equation (1) is a formula for calculating a skin depth. In actuality, the coating thickness is preferably calculated by adding several μm (0.5 to 1.5 μm) to the calculated value d μm.

Alternatively, the thickness of the low impedance layer 6 may be configured to be between 1.0 μm and 3.5 μm. The electrical conductivity of the above described metals constituting the low impedance layer 6 is in a range between $10 \cdot 10^6$ and $60 \cdot 10^6$ (S/m). Since a microwave of 2.45 GHz in frequency is employed as the electromagnetic wave supplied to the ignition plug 1, it is possible to reduce the power loss of the microwave by configuring the coating thickness to be between 1.0 μm and 3.5 μm.

The insulator 3 is a ceramic made of a material having high insulation and resistance to heat and corrosion such as alumina ($Al_2O_3$). The insulator 3 is manufactured by a well-known method such that alumina powder is formed by isostatic pressing, grinded by whetstone or the like, and baked at approximately 1600 degrees Celsius. The axial hole 30, which the center electrode 2 is fitted into, is formed with a ramp part 30*a* for locking a large diameter part 20*b* of the electrode main body 20, which will be described later.

The center electrode 2 is constituted by the electrode main body 20, which is provided at a tip end thereof with an electrode tip part 20*a* for the spark discharge with the ground electrode 5, and the terminal metal fitting 21 provided at one end thereof with an input terminal 25 that is connected with an output terminal of the pulse voltage and the electromagnetic wave (microwave). The electrode main body 20 is provided at a back end side thereof with the above described large diameter part 20*b* that is engaged with the ramp part 30*a* of the axial hole 30. The terminal metal fitting 21 is an axis-like body electrically connected at the other end thereof with the electrode main body 20. The electrode tip part 20*a* is joined on a tip end surface of the electrode main body 20. As the electrode tip part 20*a*, a noble metal having a high melting point and oxidation resistance such as platinum alloy and iridium may be preferably employed.

In view of heat dissipation of the electrode tip part 20*a* that usually rises high in temperature, the tip end of the electrode main body 20 is configured in a two-layered structure including an axis core part and a surface. The axis core part is made of a material having high thermal conductivity such as copper and silver, while the surface is made of nickel alloy excellent in resistance to heat and oxidation. However, in the case of the ignition plug 1, depending on the metal coated on the outer peripheral surface of the center electrode 2 as the low impedance layer 6, the electrode main body 20 may not necessarily be made of the two layered structure of. For example, if the metal is silver, copper, or the like, the low impedance layer 6 can solve the problem of heat dissipation at the electrode tip part 20*a*, thereby eliminating the need of the electrode main body 20 to be made of two-layered structure.

The back end side of the electrode main body 20 and the tip end side of the terminal metal fitting 21 may be joined in direct contact with each other. However, the center electrode 2 is joined to the insulator 3 by forming a seal at a temperature (900 to 1000 degrees Celsius) higher than the glass softening point with a powder (hereinafter, referred to as "a conductive mixed powder") intervening between the electrode main body 20 and the terminal metal fitting 21. The conductive mixed powder is obtained by adding an electrically conductive glass powder to copper tungsten mixed powder, chromium nickel mixed powder, or titanium nickel mixed powder. More particularly, the electrode main body 20 of the center electrode 2 is inserted into the axial hole 30, and the large diameter part 20*b* is engaged with the ramp part 30*a* at a position such that the electrode tip part 20*a* is exposed from the tip end of the insulator 3. Subsequently, after a predetermined amount of the conductive mixed powder is filled so as to cover the large diameter part 20*b*, the tip end of the terminal metal fitting 21 is brought onto the conductive mixed powder, and the electrode main part 20 and the terminal metal fitting 21 are heated at a temperature higher than the glass softening point so as to be sealed and fixed to each other. The heating is preferably performed in a manner such that the terminal metal fitting 21 is pushed and inserted so that an input terminal part thereof is positioned at a predetermined position in relation to an edge surface of the insulator 3. Here, the input terminal part of the terminal metal fitting 21 may be configured to have a flange part which is adapted to abut on the edge surface of the insulator 3. However, the flange part will serve as a reflection point of the supplied microwave, which induces a power loss. Accordingly, as shown in FIG. 1, the terminal metal fitting 21 is preferably configured in a straight shape without having any uneven part such as the flange part.

The main metal fitting 4 is an approximately cylindrical shaped case made of metal. The main metal fitting 4 is adapted to support an outer periphery of the insulator 3 and accommodate the insulator 3. An inner peripheral surface of a tip end part of the main metal fitting 4 is separated from an outer peripheral surface of a tip end part of the insulator 3 by a gap formed therebetween. A male thread part 41 is formed on an outer peripheral surface of the main metal fitting 4 at a tip end side thereof as an installation structure to an internal combustion engine. The ignition plug 1 is screwed and fixed to a cylinder head by threading the male thread part 41 of the main metal fitting 4 into a female thread part of a plug hole of a cylinder head (not shown). The main metal fitting 4 is formed with a wrench fitting part 40 for fitting with a plug wrench at a higher part thereof. Between the wrench fitting part 40 of the main metal fitting 4 and the insulator 3, powder talc is filled as a seal member, and an edge part of the main metal fitting 4 is mechanically caulked.

The ground electrode 5 forms a discharge gap for a spark discharge with the center electrode 2. The ground electrode 5 is constituted by a ground electrode main body 5*b* and a ground electrode tip part 5*a*. The ground electrode main body 5*b* is a conductor in a shape of a curved plate. The ground electrode main body 5*b* is joined at one end thereof to a tip end surface of the main metal fitting 4. The ground electrode main body 5*b* extends along an axial center of the ignition plug 1 and is bent approximately 90 degrees inward.

The ground electrode main body 5*b* is provided with the ground electrode tip part 5*a* at a tip end side thereof, which faces toward the electrode tip part 20*a* provided to the tip end of the electrode main body 20.

As described above, by coating the surface of the center electrode 2 with a metal having magnetic permeability lower than iron, and especially by configuring the metal coating thickness determined based on the skin depth acquired from the magnetic permeability and electrical conductivity of the metal to be coated, it becomes possible to effectively reduce the power loss of the electromagnetic wave without forming the low impedance layer 6 thicker than needed.

Effect of First Embodiment

The ignition plug according to the first embodiment is provided with the low impedance layer made of the material having magnetic permeability lower than iron. Accordingly, even though iron is the main component of the center electrode, which is supplied with the pulse voltage for the spark discharge and the high frequency power of the electromagnetic wave, especially the microwave, provided as energy to the spark discharge, it becomes possible to provide an ignition plug having low power loss of the supplied microwave.

<Second Embodiment>

Ignition Plug

The second embodiment is directed to the ignition plug according to the present invention. The second embodiment is different from the first embodiment in that the ignition plug according to the second embodiment is equipped with a resistor inside thereof. Descriptions are omitted of constituents similar to the first embodiment such as the insulator 3, the main metal fitting 4, the ground electrode 5, and the like.

Figure 2:
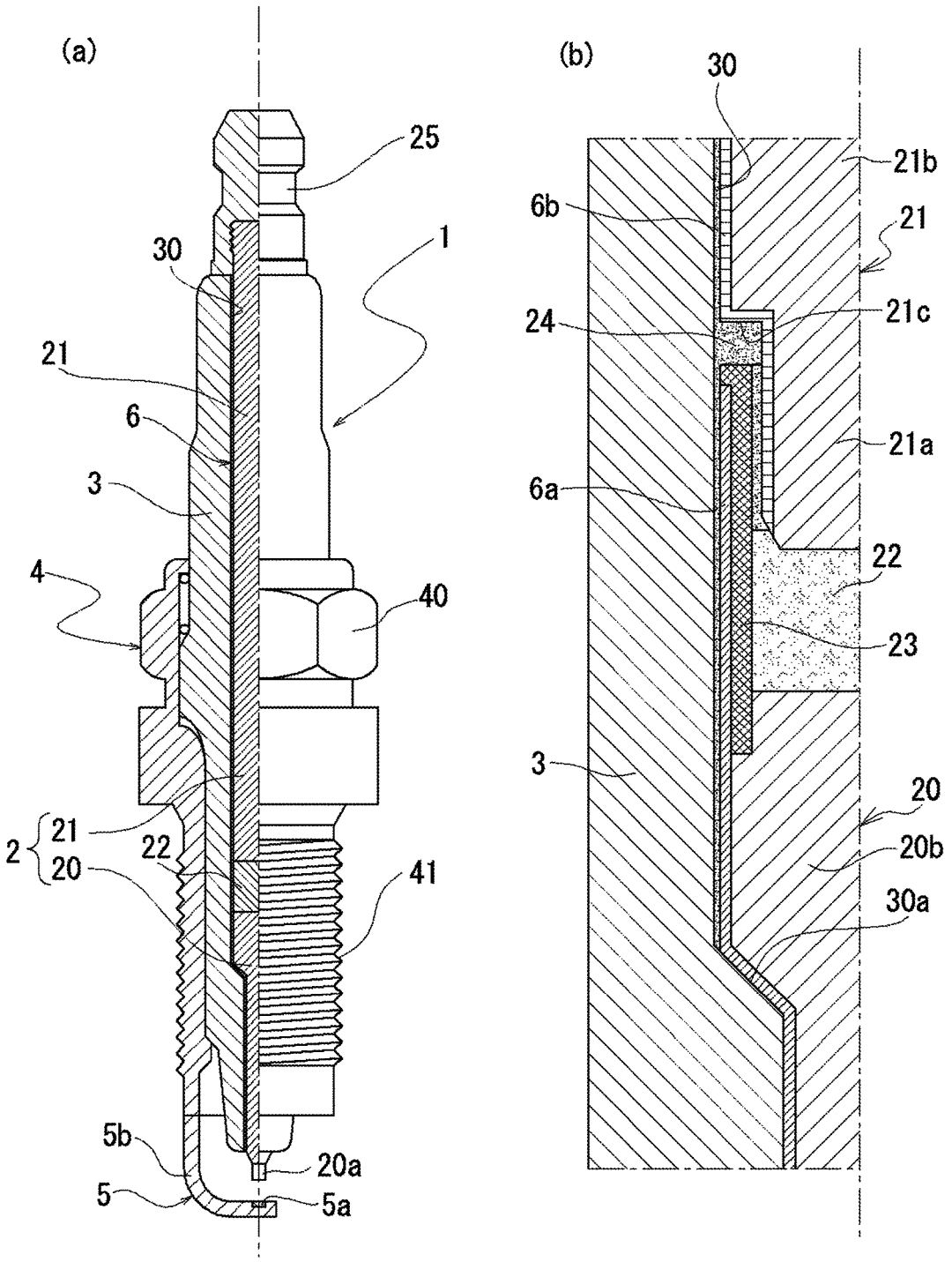
FIG. 2A is a partial cross sectional view of an ignition plug according to a second embodiment of the present invention.
FIG. 2B is an enlarged cross sectional view showing a junction part of the ignition plug, in which a resistor intervenes between an electrode main body and a terminal metal fitting.

FIG. 2 shows an ignition plug 1 according to the second embodiment. Similarly to the first embodiment, the ignition plug 1 is provided with a center electrode 2, the insulator 3 formed with an axial hole 30 which the center electrode 2 is fitted into, the main metal fitting 4 arranged in a manner so as to surround the insulator 3, the ground electrode 5 that forms a discharge gap for a spark discharge with the center electrode 2. The center electrode 2 is electrically supplied with a pulse voltage for the spark discharge and an electromagnetic wave provided as energy to the spark discharge. Between the outer peripheral surface of the center electrode 2 and the inner peripheral surface of the axial hole 30 of the insulator 3, the low impedance layer 6 made of a material having magnetic permeability lower than iron is provided. The low impedance layer 6 reduces the power loss of the electromagnetic wave that flows on the surface of the center electrode 2. More particularly, similarly to the first embodiment, the low impedance layer 6 is made of silver, copper, gold, aluminum, tungsten, molybdenum, titanium, zirconium, niobium, tantalum, bismuth, lead, tin, an alloy composed mainly of these metals, or a composite material of these metals.

In an internal combustion engine for a vehicle, a resistor is equipped in a plug cord or a plug cap of an ignition coil for pulse voltage application for the purpose of preventing the influence of a noise caused by a spark discharge on electronic devices of the vehicle (electric noise prevention). As a method less expensive than providing the resistor in the plug cord or the plug cap, another method is generally employed of providing the resistor inside the ignition plug. A resistor enclosed in a recent ignition plug called "monolithic type" is formed in a manner such that a composite powder material obtained by mixing a glass powder, a metal powder, and a carbon powder is filled between the terminal metal fitting 21 and the electrode main body 20 of the center electrode 2 and then sealed at a temperature (900 to 1000 degrees Celsius) higher than the glass softening point. The ignition plug 1 according to the second embodiment is equipped with a resistor 22 inside thereof.

Hereinafter, a description will be given of a configuration of the ignition plug 1 equipped with the resistor 22 inside thereof for reducing the power loss of the electromagnetic wave (microwave).

As shown in FIG. 2B, the electrode main body 20 of the center electrode 2 employed in the ignition plug 1 is integrally formed with a tube-like shaped dielectric cylinder 23 at an edge part on a side of the terminal metal fitting 21. The method of joining the dielectric cylinder 23 and the electrode main body 20 is not particularly limited. However, the edge part of the electrode main body 20 may be provided with a step part having a diameter approximately the same as an inner diameter of the dielectric cylinder 23 so as to fit with the dielectric cylinder 23. Thus it is possible to join the dielectric cylinder 23 and the electrode main body 20. The dielectric cylinder 23 is provided with a flange part at outside of an edge part thereof. A metal coating is applied from the flange part toward a tip end side of the electrode main body 20 on surfaces of the dielectric cylinder 23 and the electrode main body 20 to form a low impedance layer 6*a*. The dielectric cylinder 23 is not limited to particular material, and any dielectric having high insulation and resistance to heat and corrosion may suffice. Similarly to the insulator 3, the dielectric cylinder 23 may be configured by a ceramic based on alumina ($Al_2O_3$) or the like.

The terminal metal fitting 21 of the center electrode 2 is provided with an insertion part 21*a* having a diameter at an edge part thereof on a side of the electrode main body 20 smaller than the inner diameter of the tube-like shaped dielectric cylinder 23, and a main body 21*b* having a diameter larger than the insertion part 21*a* and smaller than the axial hole 30 of the insulator 3. A metal coating is applied on a surface of the terminal metal fitting 21 to form a low impedance layer 6*b*. A gap distance between an outer surface of the insertion part 21*a* and an inner surface of the dielectric cylinder 23 is preferably configured as close to zero as possible, and the edge part of the insertion part 21*a* is preferably chamfered.

Figure 3:
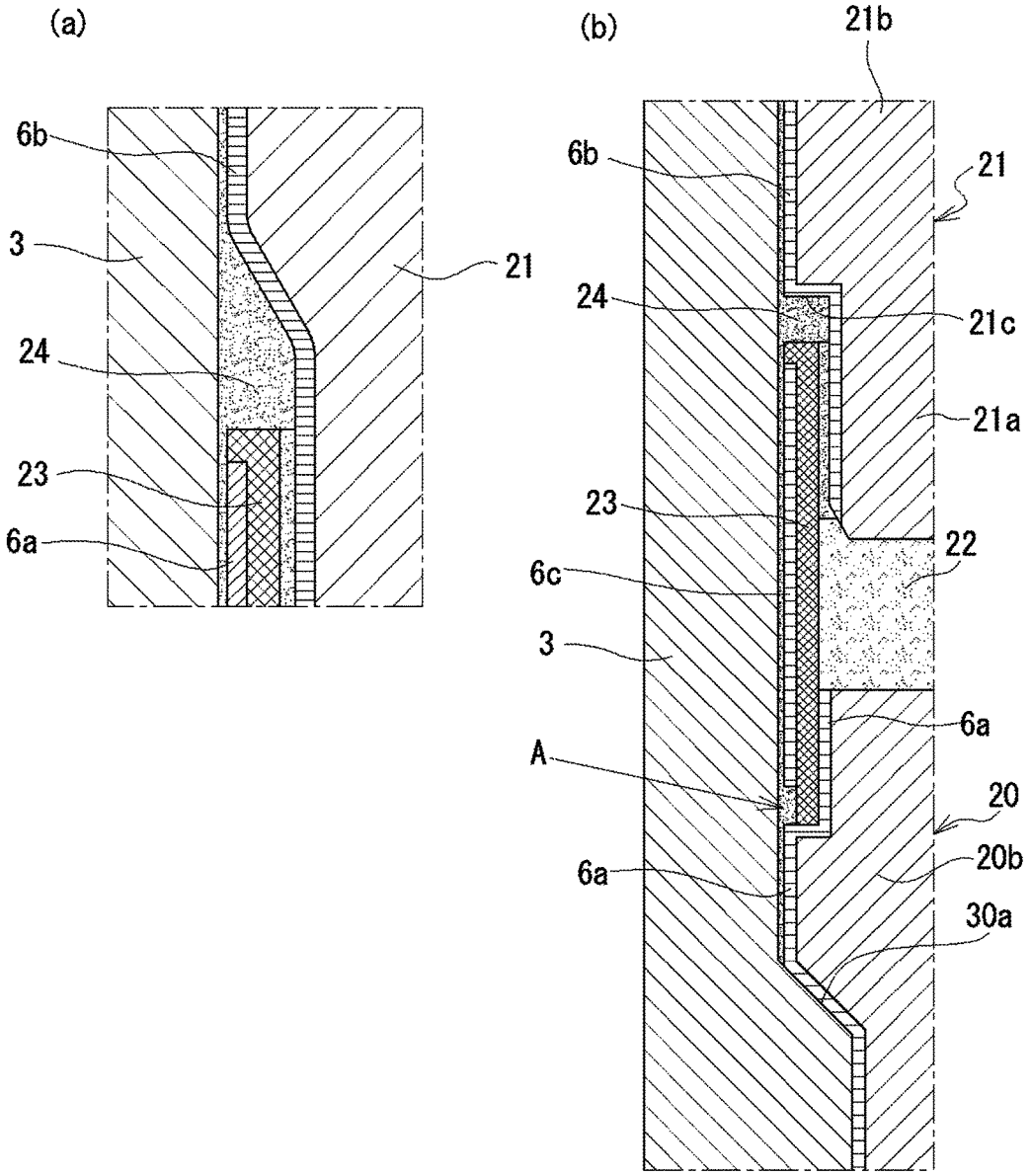
FIG. 3A is a diagram showing an example of a voltage-proof structure (electric field relaxation) in the junction part of the electrode main body and the terminal metal fitting, in which a main body of the terminal metal fitting is connected to an insertion part via a slant surface and round chamfered corners.
FIG. 3B is a diagram similar to FIG. 3A, but showing another example in which a plurality of capacitive coupling parts are provided in series.

A ring-shaped part 21*c* is formed on a surface between the main body 21*b* and the small-diameter insertion part 21*a*. In order to prevent a discharge between the ring-shaped part 21*c* and the edge part of the dielectric cylinder 23 due to the pulse voltage which is high in voltage, it is preferable to provide a sufficient gap distance, thereby implementing a voltage-proof structure (electric field relaxation). Alternatively, as shown in FIG. 3A, the main body 21*b* and the insertion part 21*a* may be connected via a slant surface and round chamfered corners.

As another method of electric field relaxation, a guard ring structure may be employed, and the metal coating constituting the low impedance layer 6 may be partially cut off in a ring-shape, thereby configuring a plurality of capacitive coupling parts in series. More particularly, as shown in FIG. 3B, the metal coating is applied to form the low impedance layer 6*a* up to an outer surface of a fitting part of the electrode main body 20 with the dielectric cylinder 23. While, the dielectric cylinder 23 is applied with a metal coating to form a low impedance layer 6*c* so that a non-coating part A is formed at a lower end part thereof, and then the dielectric cylinder 23 is fitted with the electrode main body 20. In this manner, it is possible to form capacitors (capacitive coupling parts) in series, thereby implementing the voltage-proof structure.

An assembly method of the center electrode 2 (the electrode main body 20 and the terminal metal fitting 21) to the insulator 3 is as follows: Firstly, the electrode main body 20 integrally formed with the dielectric cylinder 23 is inserted into the axial hole 30, and the large diameter part 20*b* thereof is engaged with the ramp part 30*a* at a position such that the electrode tip part 20*a* is exposed from the tip end of the insulator 3. Then, after a predetermined amount of a resistor composition powder (a composite powder material obtained by mixing a glass powder, a metal powder, and a carbon powder), which will constitute the resistor 22, is filled in the dielectric cylinder 23, a predetermined amount of a conductive mixed powder 24 for sealing is filled on the resistor composition powder so as to cover the dielectric cylinder 23. Subsequently, the insertion part 21*a* of the terminal metal fitting 21 is inserted into the dielectric cylinder 23 so as to be brought onto the resistor composition powder. Finally, the electrode main part 20 and the terminal metal fitting 21 are heated at a temperature (900 to 1000 degrees Celsius) higher than the glass softening point so as to be sealed and fixed to each other. The terminal metal fitting 21 may be heated while being pushed and inserted.

By interposing the dielectric cylinder 23 between the terminal metal fitting 21 and the electrode main part 20, the microwave flows on a surface of the low impedance layer 6*a* formed on surfaces of the dielectric cylinder 23 and the electrode main part 20, while the pulse voltage flows from the terminal metal fitting 21 via the resistor 22 to the electrode main body 20. As a result of this, it is possible to reduce the power loss of the microwave and at the same time to prevent the electric noise without equipping the resistor in the plug cord or the plug cap of the ignition coil for pulse voltage application.

Effect of Second Embodiment

With the ignition plug according to the second embodiment, even though iron is the main component of the center electrode, which is electrically supplied with both the pulse voltage for the spark discharge and the high frequency power of the electromagnetic wave, especially the microwave, provided as energy to the spark discharge, and the resistor intervenes between the terminal metal fitting and the electrode main body, the microwave is capacitively coupled via the dielectric cylinder and flows through the low impedance layer, while the pulse voltage flows from a side of the terminal metal fitting via the resistor toward a side of the electrode main body. Consequently, it becomes possible to provide an ignition plug having low power loss of the supplied microwave.

<First Modified Example of First Embodiment>

The above described configuration of the electrode main body 20 integrally configured with the dielectric cylinder 23 and the terminal metal fitting 21 provided with the insertion part 21*a* inserted into the dielectric cylinder 23 may be also applied to the plug according to the first embodiment which is not provided with the resistor 22. In this case, the conductive mixed powder 24 is employed in place of the resistor composition powder to be firstly filled.

Figure 4:
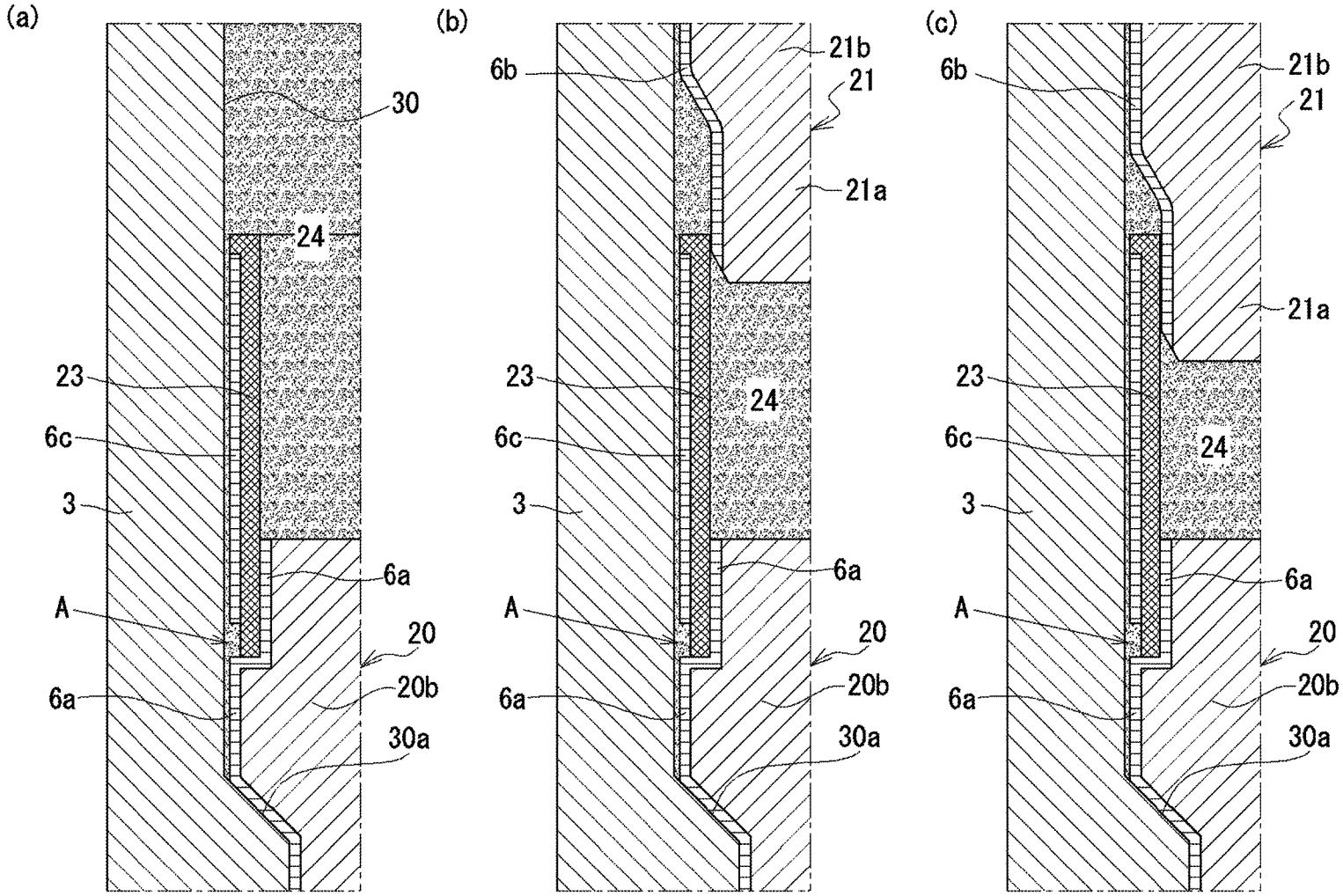
FIG. 4 is schematic explanatory views showing a method of joining the terminal metal fitting and the electrode main body of the center electrode.

FIG. 4 shows a method of joining the terminal metal fitting 21 and the electrode main body 20 of the center electrode 2 (manufacturing method of the ignition plug 1). Firstly, the electrode main body 20 integrally formed with the dielectric cylinder 23 is inserted into the axial hole 30, and the large diameter part 20*b* thereof is engaged with the ramp part 30*a* at a position such that the electrode tip part 20*a* is exposed from the tip end of the insulator 3. Subsequently, a predetermined amount of the conductive mixed powder 24 is filled so as to cover the inside and top of the dielectric cylinder 23. At this time, the conductive mixed powder 24 is also filled in a gap between the axial hole 30 and outer peripheral surfaces of the dielectric cylinder 23 and the large diameter part 20*b* of the electrode main body 20 (see FIG. 4A).

Then, the insertion part 21*a* of the terminal metal fitting 21 is caused to penetrate along the inner diameter of the dielectric cylinder 23 (see FIG. 4B).

Subsequently, while the terminal metal fitting 21 is pushed and inserted so that the input terminal part thereof is positioned at a predetermined position in relation to the edge surface of the insulator 3, the terminal metal fitting 21 and the electrode main body 20 are heated at a temperature (900 to 1000 degrees Celsius) higher than the glass softening point, thereby sealing and fixing the terminal metal fitting 21, the electrode main body 20, and the insulator 3 altogether.

Alternatively, by filling the resistor composition powder before filling the conductive mixed powder 24, it is possible to manufacture the ignition plug 1 according to the second embodiment.

In this manner, it becomes possible to reduce the power loss produced at a position of the conductive mixed powder 24 in the ignition plug 1 according to the first embodiment.

<Third Embodiment>

Plasma Generation Device

Figure 5:
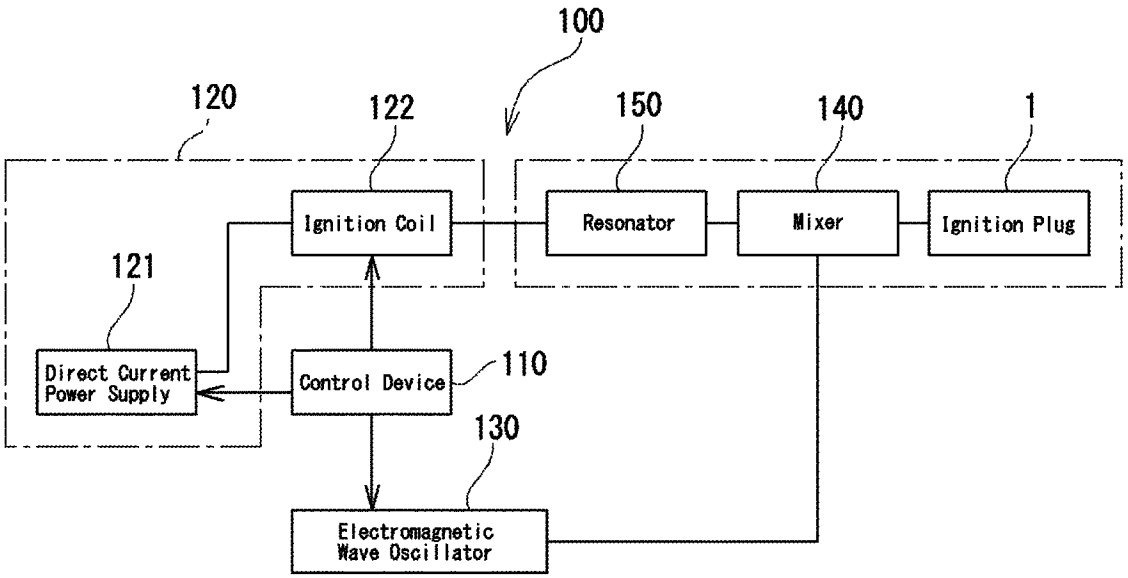
FIG. 5 is a schematic diagram showing a plasma generation device according to a third embodiment of the present invention.

As shown in FIG. 5, a plasma generation device 100 according to the third embodiment is provided with a control device 110, a high voltage pulse generation device 120, an electromagnetic wave oscillator 130, a mixer 140, and the ignition plug 1. The high voltage pulse generation device 120 includes a direct current power supply 121 and an ignition coil 122. Two pieces of energy respectively generated by the high voltage pulse generation device 120 and the electromagnetic wave oscillator 130 are transmitted to the ignition plug 1 via the mixer 140. The mixer 140 mixes the two pieces of energy supplied from the high voltage pulse generation device 120 and the electromagnetic wave oscillator 130 at respective timings.

The energy mixed by the mixer 140 is supplied to the ignition plug 1. The energy of the high voltage pulse supplied to the ignition plug 1 causes the ignition plug 1 to discharge a spark between the ground electrode tip part 5*a* and the electrode tip part 20*a* of the center electrode 2, i.e. at a gap part. Also, the energy of the microwave oscillated by the electromagnetic wave oscillator 130 enlarges and maintains discharge plasma generated by the spark discharge. The control device 110 controls the direct current power supply 121, the ignition coil 122, and the electromagnetic wave oscillator 130 so as to adjust a timing of application, intensity, and the like of energy of the microwave and the discharge from the ignition plug 1, thereby realizing a combustion condition as desired.

High Voltage Pulse Generation Device

The high voltage pulse generation device 120 includes the direct current power supply 121 and the ignition coil 122. The ignition coil 122 is electrically connected to the direct current power supply 121. Upon receiving an ignition signal from the control device 110, the ignition coil 122 boosts a voltage applied from the direct current power supply 121. The boosted pulse voltage (high voltage pulse) is outputted to the ignition plug 1 via a resonator 150 and the mixer 140.

The control device 110 controls so that the microwave is generated at a timing delayed by a predetermined time from a turn-off timing of the signal to the ignition coil 122. As a result of this, the microwave energy is effectively supplied to ionized gasses generated by the discharge, i.e. plasma, and the plasma enlarges and expands.

Electromagnetic Wave Oscillator

Upon receiving an electromagnetic drive signal from the control device 110, the electromagnetic wave oscillator 130 repeatedly outputs a microwave pulse during a period of time of a pulse width of the electromagnetic wave drive signal with a predetermined oscillation pattern. In the electromagnetic wave oscillator 130, a semiconductor oscillator generates the microwave pulse. In place of the semiconductor oscillator, another kind of oscillator such as magnetron may be employed. As a result of this, the microwave pulse is outputted to the mixer 140.

Although it has been described that one electromagnetic wave oscillator 130 is provided to one ignition plug 1 (one cylinder), in a case of a plurality of cylinders such as four cylinder internal combustion engine, it is preferably configured such that the microwave pulse from the electromagnetic wave oscillator 130 is branched and outputted to each plasma generation device 100 by means of a branching unit (not shown). In this case, the microwave attenuates by passing through the branching unit such as a switch. Consequently, it is preferably configured such that the electromagnetic wave oscillator 130 has low output such as 1 W, and before being inputted to the mixer 140 of each plasma generation device 100, the microwave passes through an amplifier (not shown). This means that it is preferably configured such that an amplifier such as a power amplifier is provided in place of the electromagnetic wave oscillator 130 as shown in FIG. 5.

The resonator 150 is a unit such as a cavity resonator adapted to resonate with the microwave leaking toward a side of the ignition coil 122 from the mixer 140. It is possible to suppress a leakage of the microwave toward the side of the ignition coil 122 by causing the microwave to resonate in the resonator 150.

The plasma generation device 100 according to the above described configuration employs the ignition plug 1 according to the first embodiment or the second embodiment for emitting the microwave into a combustion chamber of the internal combustion engine. Accordingly, it is possible to greatly reduce the power loss. As a result of this, it is possible to downsize the electromagnetic wave oscillator 130, and to reduce the size and cost of the overall device.

INDUSTRIAL APPLICABILITY

As described above, according to the present invention, since the low impedance layer made of a material having magnetic permeability lower than iron is provided between the outer peripheral surface of the center electrode and the inner peripheral surface of the axial hole of the insulator, it becomes possible to provide the ignition plug having low power loss of the supplied microwave. Accordingly, the ignition plug is preferably applied to the plasma generation device supplied with the pulse voltage for a spark discharge and the microwave provided as energy to the spark discharge. Consequently, with an internal combustion engine such as a vehicle engine employing the plasma generation device according to the present invention, it becomes possible to improve combustion efficiency and to reduce fuel consumption by use of the small sized electromagnetic wave oscillator. As a result of this, the internal combustion engine employing the plasma generation device according to the present invention is widely applicable to a vehicle, an airplane, a ship, and the like.

EXPLANATION OF REFERENCE NUMERALS

1 Ignition Plug
2 Center Electrode
20 Electrode Main Body
20*a* Electrode Tip Part
20*b* Large Diameter Part
21 Terminal metal fitting
21*a* Insertion Part
21*h* Main Body
22 Resistor
23 Dielectric Cylinder
24 Conductive Mixed Powder
3 Insulator
30 Axial Hole
30*a* Ramp Part
4 Main metal fitting
5 Ground Electrode
5*a* Ground Electrode Tip Part
5*b* Ground Electrode Main Body
6 Low Impedance Layer
100 Plasma Generation Device
110 Control Device
120 High Voltage Pulse Generation Device
130 Electromagnetic Wave Oscillator

What is claimed is:

1. An ignition plug, comprising:

a center electrode;

an insulator formed with an axial hole, which the center electrode is fitted into;

a main metal fitting arranged in a manner so as to surround the insulator; and a ground electrode adapted to form a discharge gap for spark discharge with the center electrode, wherein the center electrode is electrically supplied with a pulse voltage for spark discharge and an electromagnetic wave provided as energy to spark discharge, and a low impedance layer made of a material having magnetic permeability lower than iron is provided between an outer peripheral surface of the center electrode and an inner peripheral surface of the axial hole of the insulator, and wherein the low impedance layer is coated on the outer peripheral surface of the center electrode.

2. The ignition plug according to claim 1, wherein the low impedance layer is made of at least one selected from the group consisting of silver, copper, gold, aluminum, tungsten, molybdenum, titanium, zirconium, niobium, tantalum, bismuth, palladium, lead, tin, an alloy composed mainly of these metals, and a composite material of these metals.

3. The ignition plug according to claim 1, wherein, assuming that μ denotes magnetic permeability of a main component of the low impedance layer, ρ denotes electrical conductivity of the main component of the low impedance layer, and f denotes frequency of the supplied electromagnetic wave, the low impedance layer is configured to have a thickness expressed by the following expression $$(\pi \cdot f \cdot \mu \cdot \rho)^{-1/2}.$$

4. The ignition plug according to claim 1, wherein the low impedance layer is configured to have a thickness between 1.0 μm and 3.5 μm.

5. A plasma generation device, comprising:

a high voltage pulse generation device for supplying a pulse voltage;

an electromagnetic wave oscillator that oscillates an electromagnetic wave;

a mixer, being electrically connected to the high voltage pulse generation device and the electromagnetic wave oscillator, adapted to mix energy of the pulse voltage for spark discharge and energy of the electromagnetic wave; and the ignition plug according to claim 1 that introduces the pulse voltage for spark discharge and the electromagnetic wave provided as energy to spark discharge into a reaction region in which a combustion reaction or a plasma reaction is performed.

6. An ignition plug, comprising:

a center electrode;

an insulator formed with an axial hole, which the center electrode is fitted into;

a main metal fitting arranged in a manner so as to surround the insulator; and a ground electrode adapted to form a discharge gap for spark discharge with the center electrode, wherein the center electrode is electrically supplied with a pulse voltage for spark discharge and an electromagnetic wave provided as energy to spark discharge, and a low impedance layer made of a material having magnetic permeability lower than iron is provided between an outer peripheral surface of the center electrode and an inner peripheral surface of the axial hole of the insulator, and wherein, assuming that $\mu$ denotes magnetic permeability of a main component of the low impedance layer, $\rho$ denotes electrical conductivity of the main component of the low impedance layer, and f denotes frequency of the supplied electromagnetic wave, the low impedance layer is configured to have a thickness expressed by the following expression $$(\pi \cdot f \cdot \mu \cdot \rho)^{-1/2}.$$

* * * * *